United States Patent [19]

Chun-Hoi et al.

[11] Patent Number: 4,824,416

[45] Date of Patent: Apr. 25, 1989

[54] DANCING KEIKI DOLLS

[75] Inventors: Lo Chun-Hoi, Kwai Chung, Hong Kong; Douglas S. T. Kim, 1350 Ala Moana Blvd., No. 403, Honolulu, Hi. 96814

[73] Assignee: Douglas S. T. Kim, Honolulu, Hi.

[21] Appl. No.: 143,062

[22] Filed: Jan. 12, 1988

[51] Int. Cl.[4] ..... A63H 3/28; A63H 19/60; A63H 13/00

[52] U.S. Cl. ..... 446/298; 446/331; 446/357

[58] Field of Search ..... 446/298, 297, 299, 300, 446/301, 302, 303, 332, 357, 359, 358, 353, 333, 318, 330, 352, 354; 40/457

[56] References Cited

U.S. PATENT DOCUMENTS

| | | | |
|---|---|---|---|
| 3,643,374 | 2/1972 | Gunther et al. | 446/359 |
| 3,672,092 | 6/1972 | Tepper et al. | 446/359 |
| 4,157,630 | 6/1979 | Sawai | 446/9 |
| 4,545,775 | 10/1985 | Kim | 446/299 |
| 4,573,939 | 3/1986 | Hoshino | 446/298 |
| 4,676,764 | 6/1987 | Yeu | 446/298 |

*Primary Examiner*—Richard J. Johnson
*Assistant Examiner*—Michael Brown
*Attorney, Agent, or Firm*—Fleit, Jacobson, Cohn & Price

[57] ABSTRACT

Two dancing dolls, termed "keiki" dolls, which in Hawaiian means "child" or "children" include a battery-operated drive mechanism which causes one of the dolls to shake its hips to the left and right, while the other doll simultaneously moves its legs towards and away from each other, pivoted about its heels, thereby also causing the upper torso of the doll to move. A three-position switch controls the movement of the dolls between an off position, a dancing position with musical accompaniment, and a dancing position without musical accompaniment. The single drive mechanism, through a series of gears, drives both dolls.

4 Claims, 3 Drawing Sheets

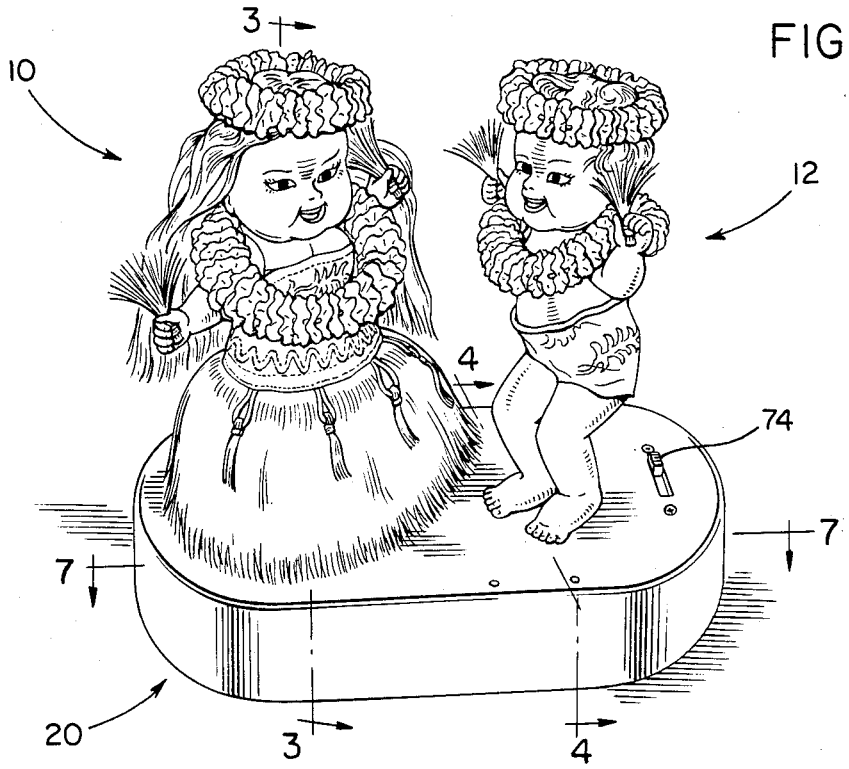
FIG. 1
FIG. 2
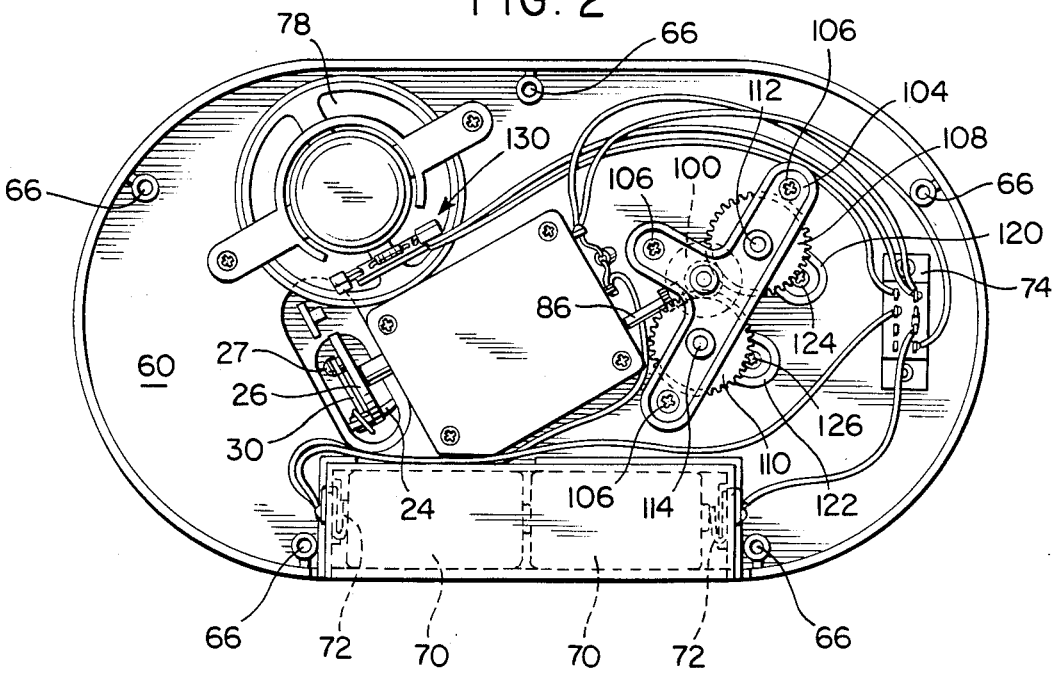

DANCING KEIKI DOLLS

FIELD OF THE INVENTION

This invention relates to dancing keiki dolls which dance with or without musical accompaniment.

BACKGROUND OF THE INVENTION

An example of a dancing hula doll is described in U.S. Pat. No. 4,545,775 to Kim, which discloses a doll which alternately moves its hips left and right while slowly rotating as a melody is played.

SUMMARY OF THE INVENTION

This invention relates to two dancing dolls, termed "keiki" dolls, which in Hawaiiam means "child" or "children". A battery-operated drive mechanism causes one of the dolls to shake its hips to the left and right, while the other doll simultaneously moves its legs towards and away from each other, pivoted about its heels, and thereby also causing the upper torso of the doll to move.

A three-position switch controls the movement of the dolls between an off position, a dancing position with musical accompaniment, and a dancing position without musical accompaniment. The drive mechanism, through a series of gears, simultaneously drives both dolls.

An object of this invention is to provide dancing dolls, including one doll which alternately moves its hips left and right and one doll which moves it legs towards and away from each other.

Another object of this invention is to provide dancing dolls, including one doll which alternately moves its hips left and right and one doll which moves its legs towards and away from each other with an optional musical accompaniment.

A further object of this invention is to provide dancing dolls, including one doll which alternately moves its hips left and right and one doll which moves its legs towards and away for each other, with an optional musical accompaniment and having a battery-powered motor driving both dolls.

Other objects, features, and advantages of the present invention will be readily apparent when the following detailed description is taken is combination with the accompanying drawings.

BRIEF DESCRIPTION OF THE DRAWINGS

FIG. 1 is a front perspective view of the dancing keiki dolls of the invention.

FIG. 2 is a bottom view of the base shown in FIG. 1, with a cover plate removed.

DESCRIPTION OF THE PREFERRED EMBODIMENTS

Figure 4:
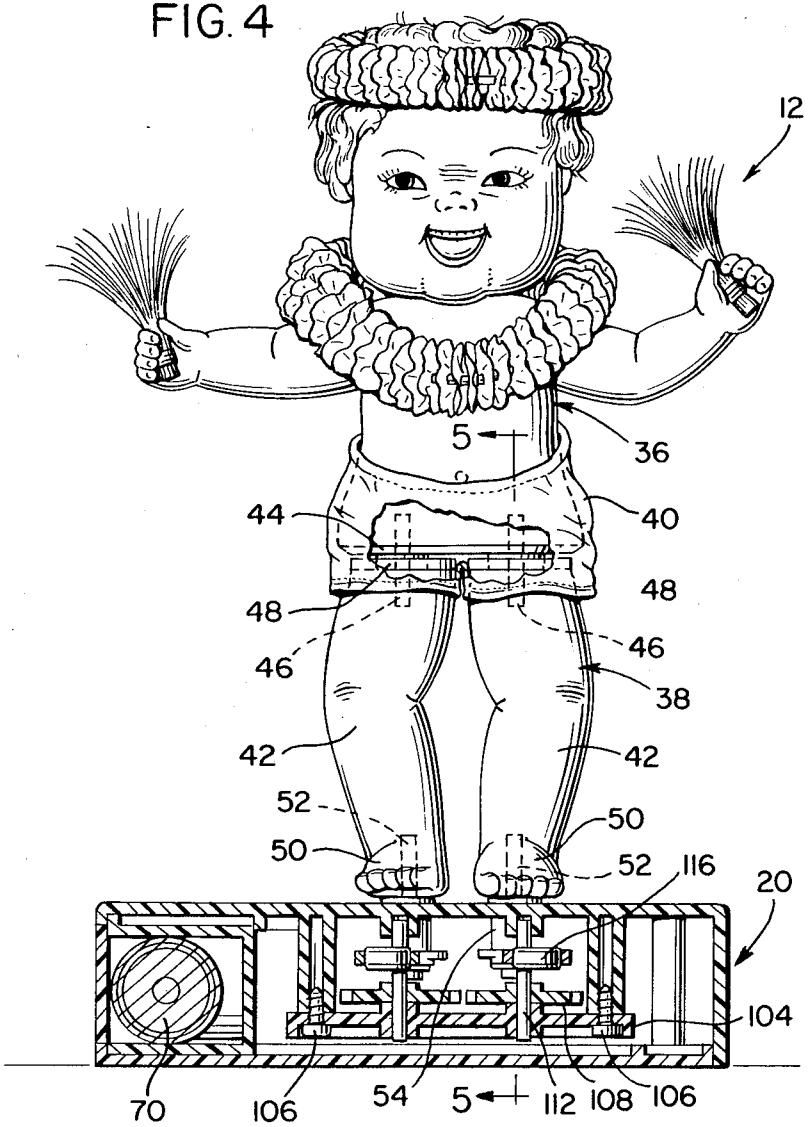
FIG. 4 is a section view taken along the line 4—4 of FIG. 1.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 3:
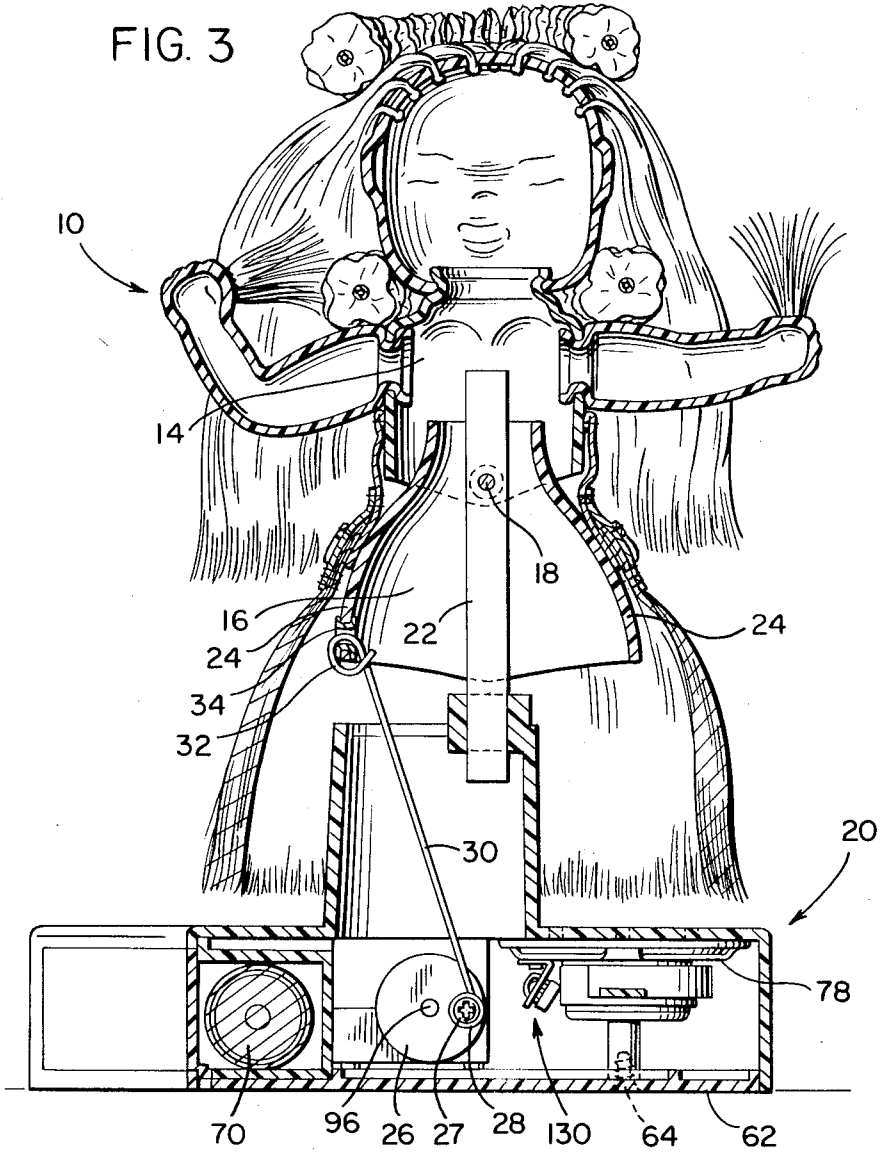
FIG. 3 is a section view taken along the line 3—3 of FIG. 1.

With reference to the drawings in general, and to FIGS. 1, 3, and 4 in particular, two dancing keiki dolls 10 and 12 are disclosed. Doll 10 represents the figure of a female child dressed in a traditional hula costume. Upper portion 14 is hollow and resembles the head through waist of a human. Lower portion 16 is hollow and resembles the waist through hip portion of a human. A grass skirt 17 covers part of the lower portion and extends to the top of the base portion 20. The upper portion 14 and lower portion 16 overlap the waist area and are pivotally connected to each other by a hinge pin 18.

Base portion 20 supports the upper portion 14 and lower portion 10 by a support rod 22, through which the hinge pin 18 extends. Upper portion 14 is spaced from lower portion 16 a predetermined distance to allow the alternate movement of hips 24 to the left and to the right.

Figure 7:
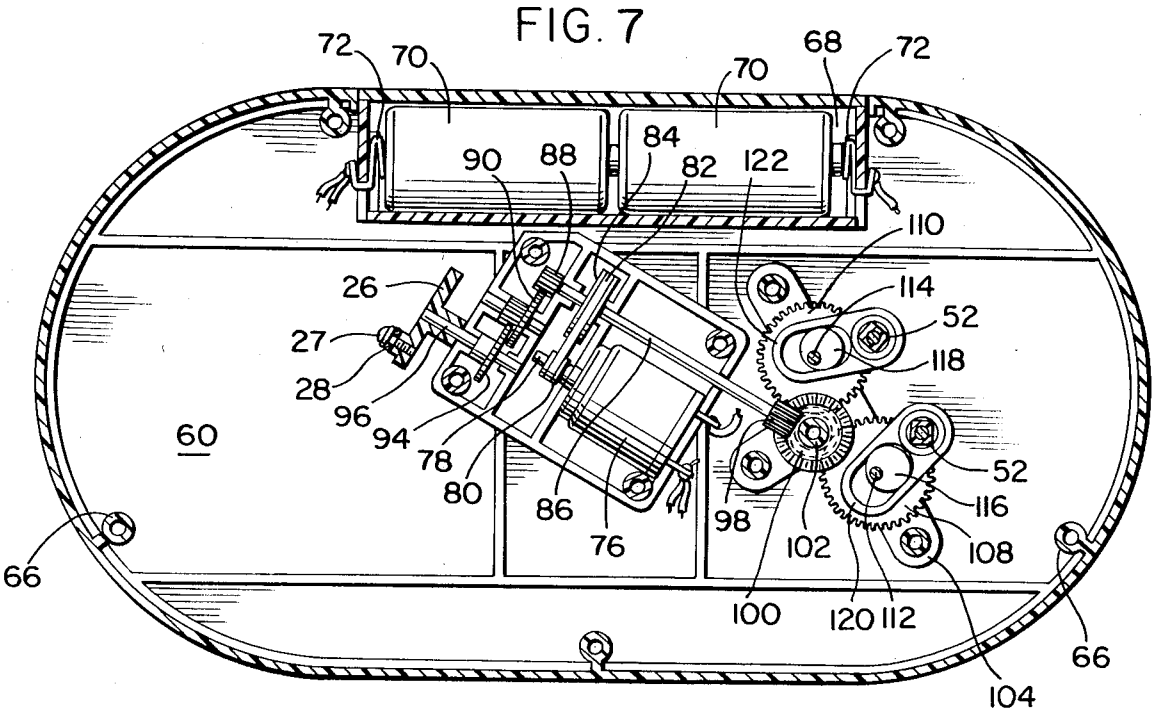
FIG. 7 is a section view taken along the line 7—7 of FIG. 1.
Figure 5:
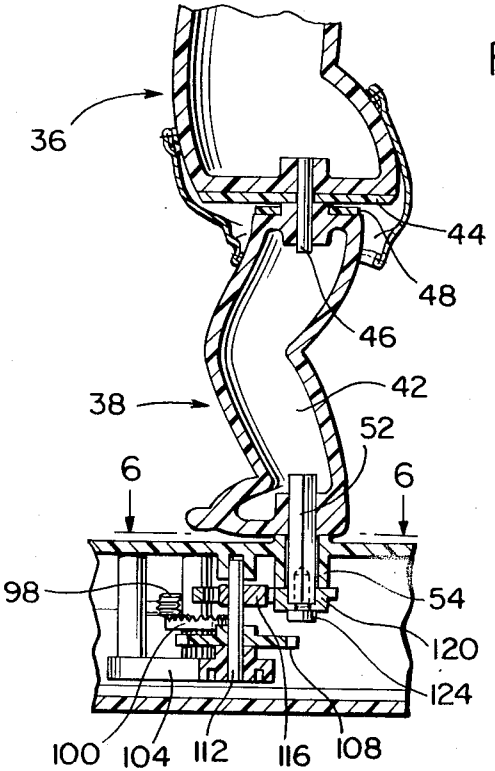
FIG. 5 is a section view taken along the line 5—5 of FIG. 4.
Figure 6:
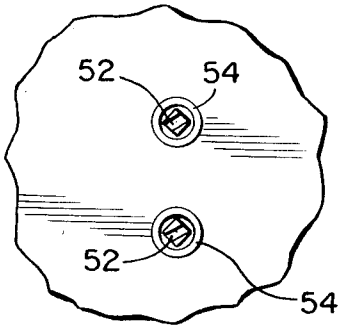
FIG. 6 is a section view taken along the line 6—6 of FIG. 5.

Lower portion 16 is caused to move to the left and right by the turning of wheel 26. Eccentrically mounted on one side of wheel 26 is screw 27 which pivotably mounts end 28 of rod 30 to wheel 26. The other end 32 of rod 30 is secured by passing through and being wrapped around a rivet 34 which is secured to the lower portion 16. By the turning of the wheel 26 about its central shaft 96, the end 28 of rod 30 is caused to slide about the shaft of screw 27 and follow a circular path which causes the hips 24 to alternately move to the left and right. The driving mechanism for wheel 26 will be disclosed with reference to FIGS. 2 and 7.

Doll 12 represents the figure of a male child dressed in a traditional costume. Doll 12 includes upper portion 36 which is hollow and resembles the head through waist of a human. Lower portion 38 is hollow and resembles the waist through feet of a human. The upper portion and lower portion meet at the waist area, which is covered by clothing 40.

Waist slide plate 44 is located at the base of the upper portion 36. Leg slide plate 48 is located at the top of each leg 42. Each of legs 42 are pivotally interconnected with waist slide plate 44 by vertically extending pins 46 for movement of the legs with respect to the upper portion 36. Waist slide plate 44 abuts against leg slide plate 48.

A foot 50 located at the base of each leg 42 is secured to square pin 52. Pin 52 extends into base 20 and is pivotably mounted in a bushing 54 which is defined by the base 20 and which projects slightly above the top of base portion 20.

The drive mechanism for the dolls 10 and 12 is housed in the base portion 20. Base portion 20 includes housing 60 with removably secured cover 62. Cover 62 is secured to the housing 60 by screws 64 driven into screw holes 66 through an opening corresponding to each screw opening 66.

In a storage compartment 68 are two 1.5 volts, size "C", batteries 70 connected in series and engaging contacts 72. A three-position switch 74 projects above the base and is movable between an off position, an actuation without musical accompaniment position, and an actuation with musical accompaniment position.

A series of electrical contacts project from the underside of switch 74 as shown in FIG. 2. Battery 70, switch 74, motor 76, and speaker 78 are electrically interconnected by wires and controlled by the positioned of the switch 74, which is manually movable. When the switch 74 is moved to either the actuated without musical accompaniment position or actuated with musical accompaniment position, motor 76 is activated to turn motor shaft 78. A pulley 80 is fixed on motor shaft 78. A belt 82 is trained over pulley 80 and pulley 84. Pulley 84 is fixed on shaft 86. Pulleys 80 and 84 have a circumferential groove for locating the belt on the pulleys.

At one end of shaft 86 is drive pinion 88. Pinion 88 engages and drives crown gear 90, which in turn drives spur gear 94 which is mounted on shaft 96 as is wheel 26. When wheel 26 is turned, screw 27, which pivotally mounts end 28 of rod 30 on wheel 26, is rotated to cause the hips 24 of doll 10 to move to the left and right.

At the opposite end of shaft 86 is drive pinion 98. Drive pinion 98 engages and drives crown gear 100. Shaft 102, upon which crown gear 100 is fixed, is mounted within T-shaped bracket 104, which is secured to the housing 60 by screws 106.

Crown gear 100 engages and drives spur gears 108 and 110, to drive gear 108 in a direction opposite to that of gear 110. Gear 108 is fixed upon shaft 112, and gear 110 is fixed on shaft 114. Shaft 112 has a cam 116 eccentrically mounted on it. Likewise, shaft 114 has a cam 118 eccentrically mounted on it.

When shafts 112 and 114 are rotated, cams 114 and 116 cause cam followers 120 and 122, respectively, tomove towards and away from each other by the sliding of the cams 114 and 116 within the oval openings defined by cam followers 122.

Cam followers 120, 122 are secured by screws 124 and 126, respectively, to rectangular pins 52. Therefore, when the cams 114 and 116 move the cam followers 120, 122 towards and away from each other, the legs 42 of doll 12 are moved towards and away from each other. When the legs of the doll 12 move towards and away from each other about the pivot pins 46 and fixed pins 52, the frictional contact of the slide plate 48 located at the top of the legs and the slide plate 44 located at the bottom of the upper portion 36 causes some motion of the upper portion 36 of the doll 12.

When switch 74 is positioned in the actuation with music accompaniment position, electric melody circuit 130, is powered to transmit an electronic melody which is broadcast by speaker 78. Speaker 78 is mounted flush against the underside of the top of housing 60, and music is broadcast through holes in the top of housing 60 located below grass skirt 17.

Having described the invention, many modifications thereto will become apparent to those skilled in the art to which it pertains without deviating from the spirit of the invention, as defined by the scope of the appended claims.

I claim:

1. Dancing dolls comprising:

a base, a first doll having an upper portion resembling the head through waist of a human, a lower portion resembling the waist through hip portion of a human, and support means supporting said upper portion and said lower portion above said base and for pivotably connecting said upper portion to said lower portion, a second doll having an upper portion resembling the head through waist of a human, a lower portion resembling the legs of a human, means supporting said lower portion on said base by the feet of said legs of said lower portion, and means for pivotably connecting said upper portion to said lower portion, and driven means to reciprocate said lower portion of said first doll transverse to said support means and to pivot said legs of said second doll towards and away from each other, said driven means including drive means located within said base, said driven means also including reciprocating means interconnecting said lower portion of said first doll and said drive means for reciprocating said lower portion of said first doll transverse to said support means, and said driven means including pin means extending through said base and being fixed to each of said legs of said second doll, said pin means being connected to said drive means for pivoting said legs of said second doll towards and away from each other simultaneously with the reciprocating of said lower portion of said first doll transverse to said support means.

2. Dancing dolls as in claim 1, wherein said drive means includes a motor driving a wheel to which one end of said reciprocating means is eccentrically mounted.

3. Dancing doll as in claim 1, wherein said drive means includes a motor driving spur gears in opposite directions of rotation with a cam mounted on a shaft of each spur gear to drive cam followers which are each fixed to a respective one said pin means fixed to said legs of said second doll.

4. Dancing dolls comprising:

a hollow base, a first doll having an upper portion resembling the head through waist of a human, a lower portion resembling the waist through hip portion of a human, support means for supporting said upper portion and said lower portion above said base including pivot means for pivotably connecting said upper portion to said lower portion, a second doll having an upper portion resembling the head through waist of a human, a lower portion resembling the legs of a human, two pins extending through said base, each pin being fixed to the front of a different one of said legs to mount the feet of said legs on said base, and means for pivotably connecting each of said legs with said upper portion, drive means located in said base, a rod interconnecting said lower portion of said first doll and said drive means to reciprocate said lower portion of said first doll transverse to said support means, and said two pins being connected to said drive means to pivot both of said feet of said legs of said second doll towards and away from each other, said drive means including a motor driving a wheel, one end of said rod being eccentrically mounted on said wheel, and said motor drives spur gears in opposite directions of rotation, a cam being mounted on a shaft of each spur gear to drive cam followers fixed to said two pins.

* * * * *